US010100817B2

(12) United States Patent
Diebold

(10) Patent No.: US 10,100,817 B2
(45) Date of Patent: Oct. 16, 2018

(54) HYDRAULIC MACHINE OF AXIAL-PISTON DESIGN

(71) Applicant: Robert Bosch GmbH, Stuttgart (DE)

(72) Inventor: Carola Diebold, Eutingen (DE)

(73) Assignee: Robert Bosch GmbH, Stuttgart (DE)

( * ) Notice: Subject to any disclaimer, the term of this patent is extended or adjusted under 35 U.S.C. 154(b) by 731 days.

(21) Appl. No.: 14/555,014

(22) Filed: Nov. 26, 2014

(65) Prior Publication Data

US 2015/0152730 A1 Jun. 4, 2015

(30) Foreign Application Priority Data

Nov. 26, 2013 (DE) ..... 10 2013 224 112

(51) Int. Cl.
*F01B 3/00* (2006.01)
*F04B 1/32* (2006.01)
*F15B 13/04* (2006.01)

(52) U.S. Cl.
CPC ..... *F04B 1/324* (2013.01); *F01B 3/007* (2013.01); *F01B 3/0055* (2013.01); *F15B 13/0402* (2013.01); *F15B 13/0403* (2013.01)

(58) Field of Classification Search
CPC .... F04B 1/20; F04B 1/32; F04B 1/324; F04B 1/2078; F04B 1/295; F04B 1/328; F04B 43/12; F04B 43/1215; F04B 43/1253; F04B 43/1269; F04B 49/02; F04B 49/06; F15B 11/02; F15B 13/0402; F15B 13/0406; F15B 13/0403; F01B 3/007; F01B 3/0055
USPC ..... 91/459, 13; 251/31, 283; 137/625.69; 417/476, 477.1, 477.2, 477.3
See application file for complete search history.

(56) References Cited

U.S. PATENT DOCUMENTS 4,375,942 A * 3/1983 Olson ..... F04B 1/324 417/222.1
7,334,513 B2 * 2/2008 Belser ..... F04B 1/324 92/12.1
2012/0186441 A1 * 7/2012 Wang ..... F03C 1/0668 91/505

FOREIGN PATENT DOCUMENTS

DE 199 49 169 A1 4/2001
DE 10 2011 012 905 A1 10/2011

OTHER PUBLICATIONS

Axial Piston Variable Motor A10VM Plug-in Version A10VE, RA 91 703-A/03.10, Data Sheet; Mar. 2010; Bosch Rexroth Corporation, Fountain Inn, South Carolina, USA (28 pages).

* cited by examiner

*Primary Examiner* — Devon Kramer
*Assistant Examiner* — Thomas Cash
(74) *Attorney, Agent, or Firm* — Maginot, Moore & Beck LLP

(57) ABSTRACT

A hydraulic axial-piston machine achieves a control cut-off by an additional control edge of a control valve of an actuating mechanism for swiveling a swash plate.

12 Claims, 5 Drawing Sheets

FIG. 3a
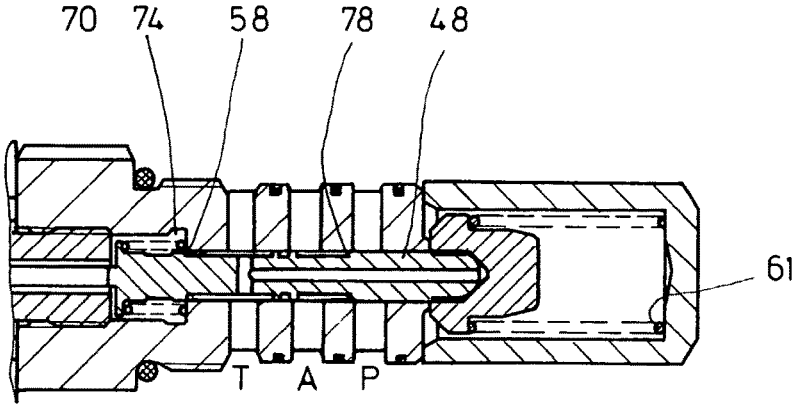
FIG. 3b
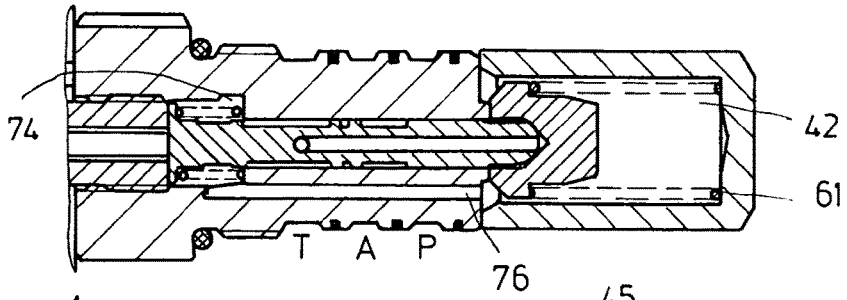
FIG. 3c
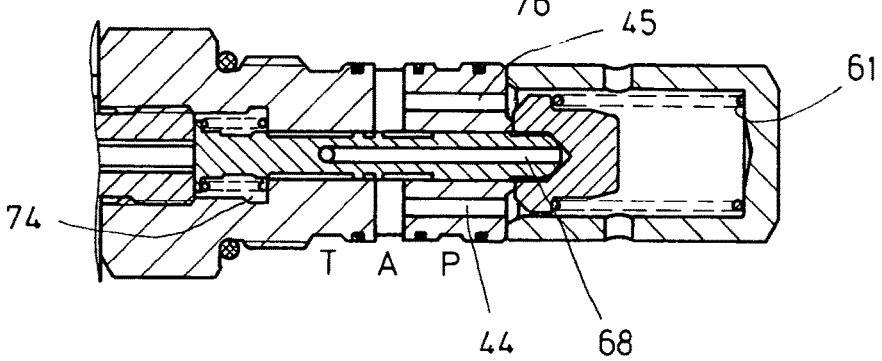
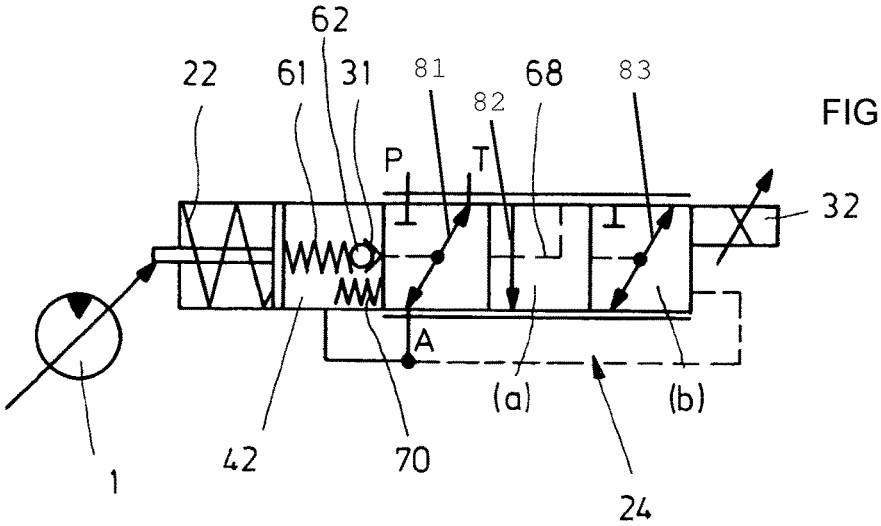
FIG. 3d

HYDRAULIC MACHINE OF AXIAL-PISTON DESIGN

This application claims priority under 35 U.S.C. § 119 to patent application no. DE 10 2013 224 112.7, filed on Nov. 26, 2013 in Germany, the disclosure of which is incorporated herein by reference in its entirety.

BACKGROUND

The disclosure relates to a hydraulic machine of axial-piston design.

Such adjustable hydraulic machines disclosed in the Bosch Rexroth AG specification RD 91703/03.10 are used, for example, to drive a fan of an internal combustion engine. The hydraulic motor usually comprises a cylindrical drum, in which a plurality of working chambers is formed, which are each defined by an axial piston. These pistons are supported at the foot end on a swash plate, the swivel angle of which can be adjusted by means of an actuating device in order to adjust the displacement. In the solution disclosed by the aforementioned prior art the actuating device allows a two-point adjustment in order to adjust the swash plate from a minimum swivel angle to a maximum swivel angle and vice-versa, this adjustment being a stepped adjustment.

DE 10 2011 012 905 A1 shows fan drives, in which the hydraulic motors, however, are not of the generic swash plate design but of bent-axis design.

DE 199 49 169 C2 shows a hydraulic pump of axial-piston design, in which the swash plate is adjusted by means of a proportionally adjustable actuating valve, which serves to control an actuating piston of an actuating cylinder, in order to adjust the swash plate in the direction of a reduced displacement. In this known solution a return spring acts in the opposite direction, that is to say in the direction of an increased displacement.

One problem with these known solutions is that with a transient loss of control signal the pump swivels in the direction of a minimum displacement, since the actuating valve is usually designed so that in the basic position (with the proportional solenoid in an non-energized state) the pump pressure acts in the actuation chamber, and the actuating cylinder therefore runs out and the swash plate swivels in. Accordingly a consumer can then no longer be adequately supplied with fluid, for example. To cope with transient malfunctions, a control cut-off should be provided, in which in the event of a transient loss of control signal the low pressure is operative in the actuation chamber and the pump swash plate therefore swivels out in the direction of maximum displacement.

The object of the disclosure is to create a hydraulic machine in which this control deviation is achieved for a minimum outlay in terms of mechanical devices.

SUMMARY

This object is achieved by a hydraulic machine having the features of the disclosure.

Advantageous developments of the disclosure form the subject matter of the dependent claims.

The hydraulic machine according to the disclosure comprises a cylindrical drum, in which a plurality of pistons is guided, which together with the cylindrical drum each define a working chamber. The pistons are supported at the foot end on a swash plate, the swivel angle of which can be adjusted by means of an actuating cylinder of an actuating device in order to adjust the displacement. The actuating cylinder comprises an actuation chamber, which by way of a proportionally adjustable actuating valve can be connected to high pressure or low pressure. Here a control piston of the actuating valve serves to adjust a control cross section. The swivel position of the swash plate is preferably forcibly fed back to the control piston of the proportionally adjustable actuating valve by means of a measuring spring, so that the actuating device is situated in its regular position when the spring forces acting on the control piston are in equilibrium with the control force that adjusts the control piston.

For the control cut-off the control piston is designed with an additional control edge, which in the event of a signal loss serves to open a pilot oil connection between the actuation chamber and low pressure. In other words, in the basic position of the control piston this additional control edge relieves the actuation chamber in relation to the tank, so that the swash plate swivels out and the maximum displacement is accordingly set, so that a supply of fluid to the consumer is ensured. At the same time the connection from the high pressure into the actuation chamber is interrupted.

A distinctive feature of this solution is the small overall space, since no additional control elements need to be provided for the control cut-off.

In an especially preferred solution the actuating valve is adjusted by a proportional solenoid, a tappet submerging into a solenoid chamber into which the tappet-side end portion of the control piston also projects, the latter being biased by a spring into a position in which it bears against the tappet. The additional control edge serves to open a pilot oil connection to the solenoid chamber, which in turn has a fluid connection to the actuation chamber, so that at the end face substantially the same control pressure is acting on the actuating piston. This fluid connection between the solenoid chamber and the actuation chamber is usually already provided, so that in principle only the additional control edge on the control piston needs to be provided for control cut-off purposes. In order to minimize pilot oil losses, the connection from the high pressure into the actuation chamber is interrupted simultaneously or with a slight time offset when the solenoid chamber is opened.

In a preferred variant of the disclosure the actuating valve is designed with a non-return valve, which serves to admit high pressure or an actuating pressure to the actuation chamber, bypassing the control cross section, for the purpose of prioritizing the inward swivel of the swash plate, so that the pump can be rapidly returned to a minimum displacement. This non-return valve is used particularly in variants with superimposed pressure and/or delivery rate control.

The proportionally adjustable actuating valve affords a demand-oriented adjustment of the swivel angle/displacement via control electronics of the actuating valve. A further advantage is that the basic construction of such an actuating device can be used both in hydraulic machines and in hydraulic pumps.

In a solution affording an especially compact construction the proportionally adjustable non-return valve is designed coaxially with the proportionally adjustable actuating valve.

The measuring spring may be supported on the one hand on an actuating piston of the actuating cylinder and on the other on a valve body of the non-return valve, which is braced against the control piston and together with the latter forms the non-return valve. Here a control duct, in which high pressure or a control pressure is operative during rapid inward swiveling of the swashplate, is formed in the control piston.

This valve body accordingly has a dual function: firstly it serves to support the measuring spring on the control piston, and secondly it acts as valve body of the non-return valve, the control piston being designed as valve seat and the operating point of the non-return valve being independent of the actuation of the actuating valve.

The actuating device is of particularly compact construction if the actuating piston is of cupped design, the measuring spring and a part of the valve body being accommodated or guided in the actuating piston.

The actuating valve may be designed with a connecting duct, via which the solenoid chamber is connected to the actuation chamber, so that substantially the same pressure prevails in the actuation chamber and in the solenoid chamber.

The measuring spring of the hydraulic motor is preferably designed with a spring characteristic which is significantly higher than the measuring spring in a comparable hydraulic pump. The spring characteristic is preferably more than 20% greater than in a hydraulic pump.

Accordingly the proportional solenoid of the actuating device is also somewhat stronger, so that the control piston is more strongly tensioned than when the hydraulic machine is designed as a hydraulic pump.

In a preferred exemplary embodiment a return spring acts upon the swash plate in the direction of the maximum displacement. An adjustment by an opposing piston or one additionally assisted by an opposing piston is also feasible.

The swivel times can be further reduced if two intersecting radial ducts in the actuating valve housing are assigned to the working connection of the actuating valve, said ducts then having a pilot oil connection to the actuation chamber via at least one further duct.

BRIEF DESCRIPTION OF THE DRAWINGS

Preferred exemplary embodiments of the disclosure are explained in more detail below with reference to schematic drawings, of which:

FIGS. 3*a* to 3*c* show the actuating valve in FIG. 2 in the position for control cut-off in various sectional representations, FIG. 3*d* shows a switch symbol of the actuating device.

DETAILED DESCRIPTION

The hydraulic machine according to the disclosure is explained below with reference to the example of a hydraulic motor. In principle the design features described can also be implemented in a hydraulic pump, preferably making the adjustments described below.

Figure 1:
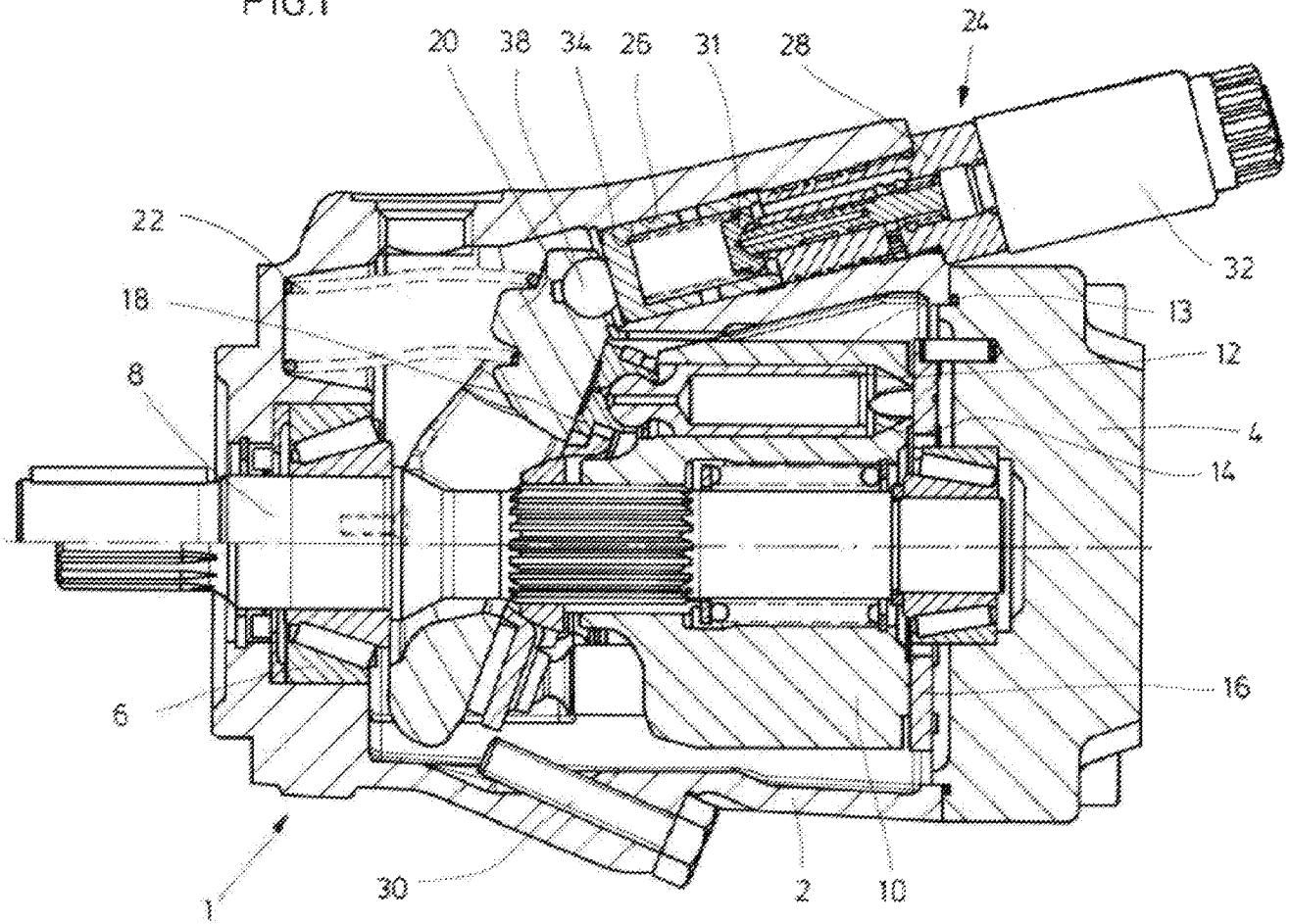
FIG. 1 shows a sectional representation of a hydraulic motor according to the disclosure, with electro-proportionally acting actuating device.

FIG. 1 shows a longitudinal section through a hydraulic motor 1 of axial-piston design. This comprises a housing 2 and a housing cover 4, in which a motor shaft 8, which serves to drive a fan wheel, for example, is supported by way of a shaft bearing 6. The motor shaft 8 is rotationally fixed to a cylindrical drum 10, in which a plurality of pistons 12 is displaceably guided. These together with the cylindrical drum each define a working chamber 14, which by way of a control disk 16 connected to the housing 2 can be connected to high pressure or low pressure according to the rotational position of the cylindrical drum 10. The foot-side end portions of the pistons 12 remote from the respective working chamber 14 are each connected to a slide shoe 18 in the manner of a ball-and-socket joint. These slide shoes 18 bear on a slide surface of a swash plate 20, which is pivotally supported in the housing 2, so that as the cylindrical drum 10 rotates the pistons 12 perform a piston stroke according to the swivel angle of the swash plate 20. A return spring 22 acts on the swash plate 20 in the direction of its maximum swivel angle shown. This return spring 22 is on the one hand supported on an end wall of the housing 2 and on the other acts on the swash plate 20 at a radial distance from the shaft axis. The swash plate 20 is adjusted against the force of the return spring 22 by means of an actuating device 24, which basically comprises an actuating cylinder 26 and an actuating valve 28. The minimum swivel angle of the swash plate 20 is defined by a stop 30 adjustably arranged in the housing. Accordingly, in the position of the swash plate 20 shown, at the maximum swivel angle the hydraulic motor 1 is set to the maximum displacement, whilst with the swash plate 20 swiveled in (bearing on the stop 30) the minimum displacement is set.

A non-return valve 31, which serves to prioritize the inward swiveling process for rapid adjustment of the hydraulic motor 1 in the direction of the minimum displacement, is integrated into the actuating device 24. The actuating valve 28 is proportionally adjustable by means of a proportional solenoid 32, so that accordingly the swivel angle and therefore also the displacement of the hydraulic motor 1 is adjustable in proportion to the energizing of the proportional solenoid 32.

Figure 2A:
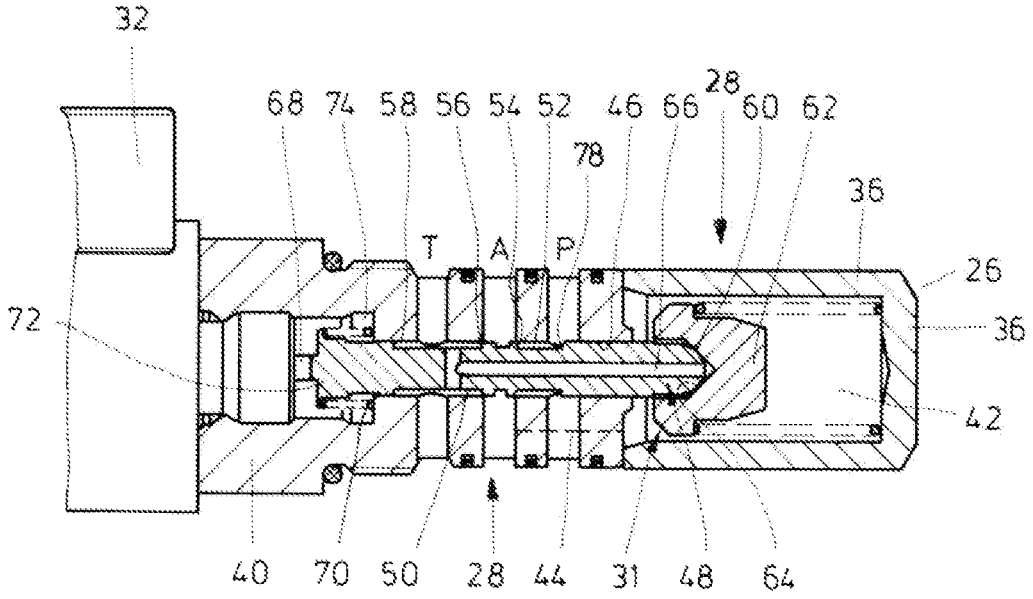
FIGS. 2*a*, 2*b* show sectional representations of a first exemplary embodiment of an actuating device of the hydraulic motor in FIG. 1 with control cut-off.
Figure 4B:
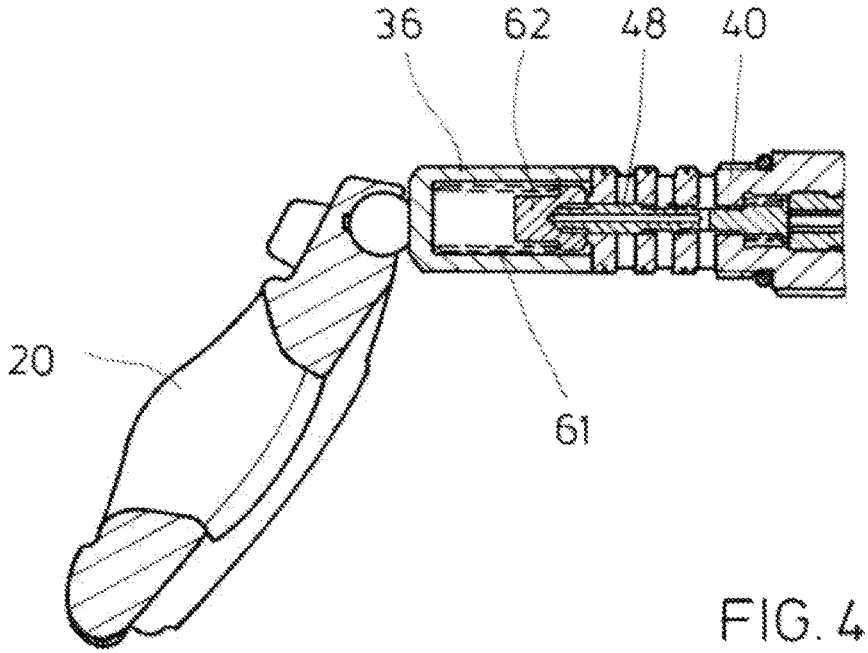
FIG. 4*b* shows an exemplary embodiment in which such tilting is prevented by the design and FIG. 5 shows an actuating valve without control cut-off and the corresponding switch symbol.

Details of the actuating device 24 are explained with reference to FIGS. 2 to 4. FIG. 2*a* shows an enlarged longitudinal section of the actuating device 28, the actuating device 28 in the view according to FIG. 2*a* being rotated through 180° about the radial axis, so that accordingly the proportional solenoid 32 is located on the left.

As explained, the actuating device 28 basically comprises the actuating cylinder 26, the electro-proportionally adjustable actuating valve 28 and the non-return valve 31. The complete actuating device 24 is of cartridge-shaped design for fitting into a mount 34 (FIG. 1) of the housing 2. The actuating cylinder 26 has a cupped actuating piston 36, which is guided so that it is axially displaceable in the mount 34 of the housing 2 and acts by way of a type of ball-and-socket joint 38 (FIG. 1) on the swash plate 20. The actuating piston 36 together with the mount 34 and an actuating valve housing 40 defines an actuation chamber 42 which, as is explained in more detail below, can be connected to high pressure or low pressure by way of the actual actuating valve 28, in order to adjust the swash plate 20 through displacement of the actuating piston 36.

The actuating valve 28 accordingly comprises a low-pressure connection T, a working connection A and high-pressure connection P. The latter is connected to the high-pressure side of the hydraulic motor, whilst the low-pressure connection T has a fluid connection to the tank or a fluid connection can be established via a pressure-regulating valve. The working connection A or its diagonal P-duct is connected to the actuation chamber 42 via two ducts 44, 45, yet to be explained in more detail below, only one duct 44 being indicated by dashed lines in the representation according to FIG. 2*a*. Accordingly the pressure set on the working connection A is also present in the actuation chamber 42.

The actuating valve housing 40 has a valve bore 46, in which a control piston 48 is adjustably guided in an axial direction. This control piston 48 has two control grooves 50, 52, between which a control flange remains, which forms two control edges 54, 56. The second annular end face of the left-hand control groove 50 in FIG. 2*a* forms a further control edge 58, which serves as a control cut-off. The right-hand control groove 52 forms a further control edge 78. This will be explored in more detail below.

The right-hand end portion of the control piston 48 in FIG. 2*a* extends into the interior of the actuating piston 36 and therefore into the actuation chamber 42. This end portion is provided with a taper 60, on which a valve body 62 tightly bears. This bearing contact is brought about by a measuring spring 61, which on the one hand is supported on the head of the actuating piston 36 and on the other acts on an annular shoulder of the valve body 62. In this bearing contact position the taper 60 submerges into a fabricated opening of the valve body 62, which forms a valve seat 64 of the non-return valve 31. The control piston 48 is formed with a bore 66, which opens out in the area of the valve seat 64 on the one hand and, via a radial bore portion, in the base of the left-hand control groove 50 in FIG. 2*a* on the other, and therefore forms a pilot oil connection 83 to the T-connection or its T-duct.

According to FIG. 2*a* the proportional solenoid 32 is attached at the end face to the actuating valve housing 40, a tappet 68 at the end face bearing on the left-hand end portion of the control piston 48 in FIG. 2*a*, so that the control piston 48 can be adjusted via the tappet 68 according to the energizing of the proportional solenoid 32. The control piston 48 is biased into its bearing contact position against the tappet 68 by the measuring spring 61, and from the start of the control by a spring 70 supported at the end face on a housing shoulder, this spring 70 acting on a spring abutment 72 of the control piston 48.

In the relative position represented in FIG. 2*a* the regular position 48 is situated in its regular position, which occurs when an equilibrium of forces prevails between the actuating forces applied by the proportional solenoid 32 and the opposing force resulting from the adjustment of the swash plate 20.

The three connections T, A, P are each formed by radial ducts of the actuating valve housing 40, the working connection A being formed by two intersecting radial ducts, one of which runs perpendicular to the drawing plane in FIG. 2*a* (see also FIG. 3*c*). In the regular position shown the two middle control edges 54, 56 have a zero overlap with the radial bores of the working connection A, so that a pilot oil connection 83 to the low-pressure connection T or the pilot oil connection 82 to the high-pressure connection P is closed. In principle, however, a positive or negative overlap may also be selected in the regular position.

In the regular position represented the pressure at the working connection A also acts, via the duct 44 and the further duct 45 not represented in FIG. 2*a* (see FIG. 3*c*), in the actuation chamber 42. The internal connection in the valve via the ducts 44 and 45 of the working connection A to the actuation chamber 42 means that such a connection through the pump housing can be dispensed with. In this position the low pressure, which is tapped via the internal bore 66 and the control groove 50, acts in the area of the valve seat 64.

Figure 2B:
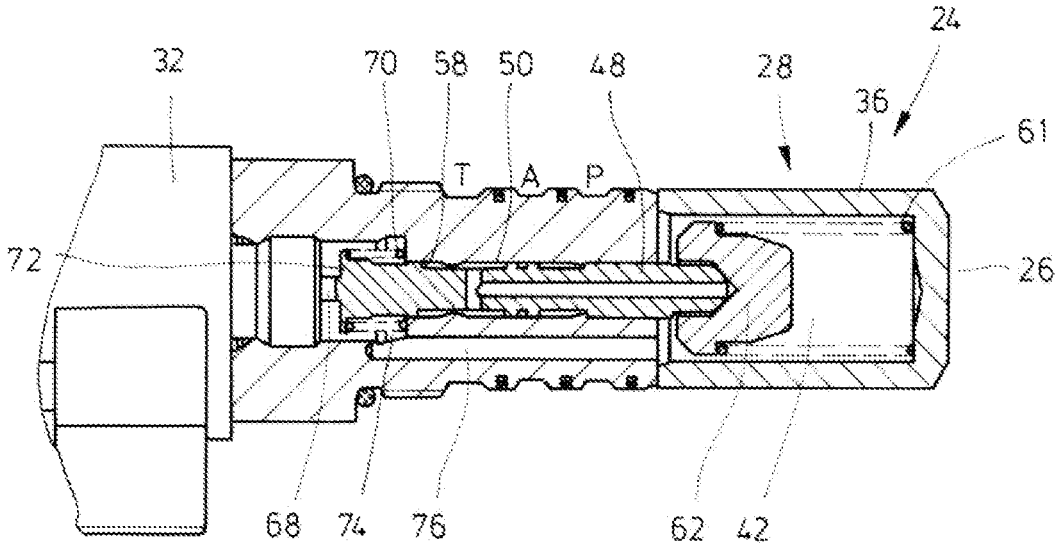

The spring 70 is arranged as a compression spring in a solenoid chamber 74, which is connected via a connecting duct 76, visible in FIG. 2*b*, to the actuation chamber 42, so that the same control pressure is present in both chambers 74, 42. This FIG. 2*b* shows a section through the actuating device 28, the sectional plane of which is offset by 45° in relation to that of FIG. 2*a*, that is to say it runs obliquely to the drawing plane in FIG. 2*a*.

In the representation according to FIGS. 3*a* to 3*c* the control edge 58 of the control groove 50 opens the pilot oil connection 81 between the low-pressure connection and the solenoid chamber 74 when the proportional solenoid 32 is not energized, so that the low pressure prevails in this chamber. This is relayed via the connecting duct 76 also to the actuation chamber 42—the actuating valve is in the "control cut-off" mode. In this case the pilot oil connection 82 between the working connection A and the high-pressure connection P is closed. By way of illustration, the actuating device 24 in FIGS. 3*a* to 3*c* is represented in this "control cut-off" position in three different sections. Here FIG. 3*a* shows a section corresponding to FIG. 2*a*. The representation according to FIG. 3*b* corresponds to that according to FIG. 2*b*, that is to say the sectional plane runs offset by approximately 45° to that in FIG. 3*a*. FIG. 3*c* finally shows a sectional profile which is offset by 90° in relation to that in FIGS. 3*a*, 2*a*, that is to say this sectional plane runs perpendicular to the drawing plane in the latter representations.

It can be seen from the representation in FIG. 3*a* that in the "control cut-off" position the control edge 58 of the control piston 48 has opened the pilot oil connection 81 between the solenoid chamber 74 and the low-pressure duct connected to the low-pressure connection T. The pilot oil connection 82 between the connections A, P is closed by the outer control edge 78 of the control groove 52. The connecting duct 76, via which, as already explained, the solenoid chamber 74 is connected to the actuation chamber 42, can be seen in the section according to FIG. 3*b*.

The two ducts 44, 45 referred to at the outset, via which the actuation chamber 42 is connected to the working connection A, or more precisely to the two intersecting radial A-ducts, can be seen in the section according to FIG. 3*c*. Accordingly, in the "control cut-off" position the low pressure is also present at the working connection A.

In control cut-off the pump swivels out to the maximum swivel angle, for example in the event of a control signal loss.

For example, should a pressure control be superimposed on the EK control previously described, which is an EP control with a cut-off position of the actuating valve, the interconnection ensues in such a way that the pressure regulator (not shown here) has priority over the electro-proportional adjustment. When the pressure regulator responds the tank connection T can then be connected to high pressure or load pressure via the pressure regulator, so that accordingly a pressure can also be built up in the actuation chamber 42 substantially regardless of the position of the control piston, 48, and the pump swivels back. In this case the non-return valve 31 described is operative. As explained, the pressure in the tank duct is tapped via the internal bore 66 of the control piston 48 and therefore acts on the valve body 62 in the opening direction. On activation of the pressure control a comparatively low actuating pressure (swash plate 20 swiveled) still prevails in the actuation chamber 42, so that the valve body 62 lifts off due to the pressure differential and pilot oil flows from the tank duct via the internal bore 66 and the opened non-return valve 31 into the actuation chamber 42, so that the actuating pressure in the latter is increased and the swash plate 20 accordingly swivels in and this inward swiveling movement is therefore prioritized. In the case of so-called DRS valves this high pressure may correspond to a relatively high control pressure, a load pressure or the like.

With the non-return valve 31 opened, a control pressure is therefore admitted to the actuation chamber, bypassing the cross-sections opened by the control edges 52, 56.

To illustrate this, the switch symbol of the actuating device 24 previously described, with the control cut-off, is shown in FIG. 3*d*. As explained above, the actuating device is biased by the return spring 22 and the measuring spring 61 towards the basic position shown, which corresponds to the "control cut-off" position. Through energizing of the proportional solenoid 32 a connection can then be made to high pressure in the A positions and to low pressure on further displacement into the b positions, so that pilot oil is delivered or drained off, in order to adjust the swivel angle. With an equilibrium of forces the regular position represented in FIG. 2*a* is adopted. According to the circuit diagram in FIG. 3*d* the spring 70 appears to be situated in the actuation chamber 42. It is located outside the actuation chamber, however, as can be seen from FIGS. 3*a* to 3*c*.

The superimposed pressure control allows a pressure to operate on the tank connection T which via the internal bore 68 then acts on the non-return valve 31, so that the valve body 62 lifts off and pilot oil can swivel directly into the actuation chamber 42, bypassing the control cross sections of the actuating valve 28.

Figure 4A:
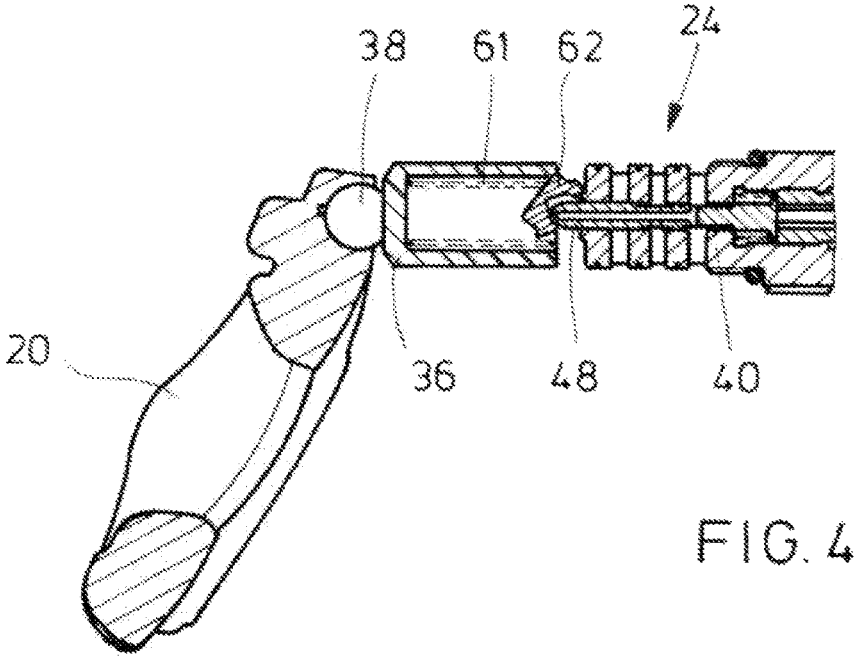
FIG. 4*a* shows a partial representation of an actuating device to illustrate a tilting of the valve body of the non-return valve.

FIG. 4*a* shows a problem which can occur with such an actuating device 24 having a non-return valve 31. Greatly simplified, this represents a part of the actuating device 24 with the control piston 48, the valve body 62 and the actuating piston 36, which is operatively connected to the swash plate 20 by the ball-and-socket joint 38. As explained, the valve body 62 of the non-return valve 31 also serves as spring plate for the measuring spring 61. As is shown in FIG. 4*a*, it may happen under unfavorable operating conditions (swivel angle, position of the control piston etc.) that the valve body 62 (in other words the spring plate of the measuring spring 61) tilts. This tilting may lead to damaging of elements of the actuating device 24, in particular the actuating piston 36, the valve body 62 and/or the control piston 48. Such short spring plates are used in axial piston pumps, for example, as are described in the publication DE 199 49 169.

Compared to this known design the valve body 62 (see FIG. 4*b*) is designed with a significantly greater axial length, the piston skirt of the actuating piston 36 also being extended in order reliably to prevent such a tilting in all switching positions. The fact that the outside diameter of the valve body 62 and the inside diameter of the actuating piston 36 are adapted for optimum guidance and tilting safeguards likewise contributes to this.

Figure 5:
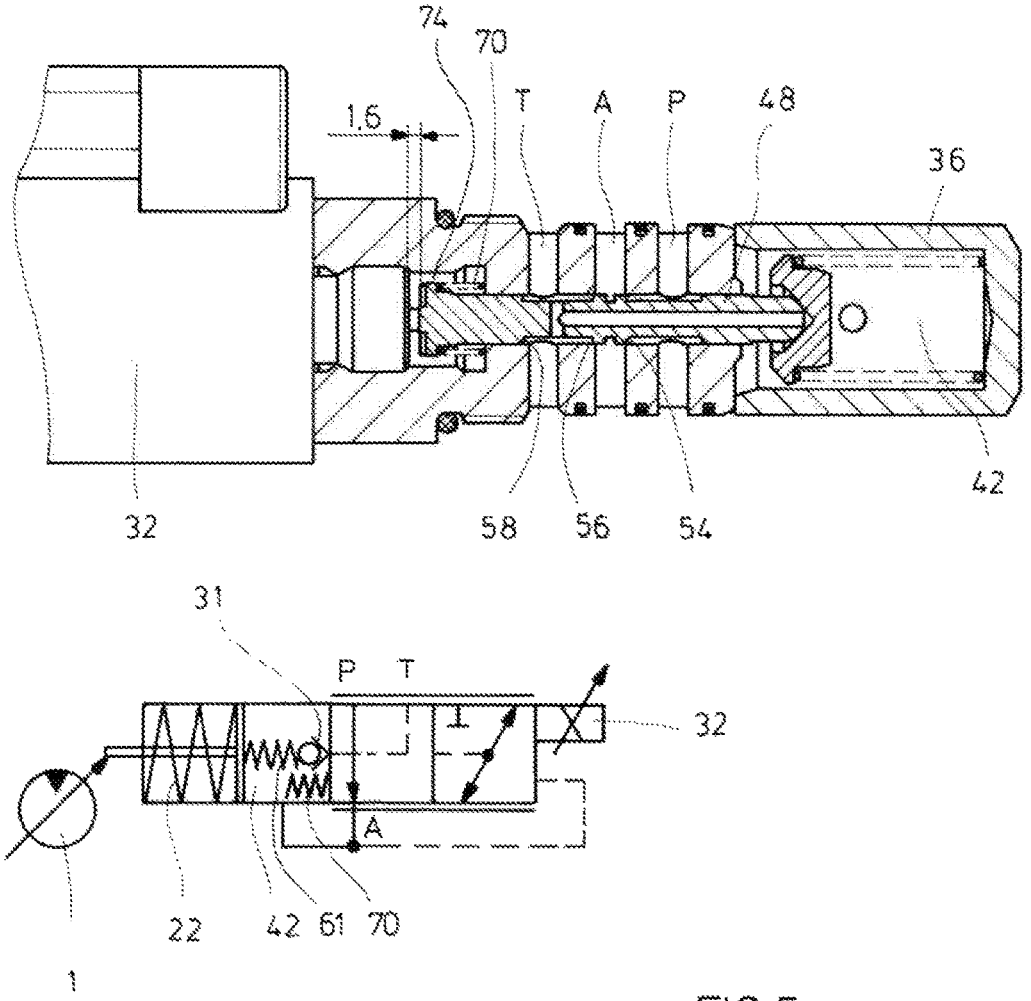

FIG. 5 shows a variant of the exemplary embodiment previously described, without control cut-off. The basic construction corresponds to the exemplary embodiment previously described, the only basic difference being that the control edge 58 does not serve to open a pilot oil connection between the tank duct and the solenoid chamber 74. The control groove 50 is therefore shorter than in the exemplary embodiment previously described. The actuating device 24 is again shown in the regular position of the actuating piston 36, in which the control edges 54, 56 control the pilot oil connection of the A-duct to the T-duct or to the P-duct. The circuit diagram is again drawn in at the bottom of FIG. 5. According to this circuit diagram the spring 70 again appears to be situated in the actuating chamber 42. It is located outside the actuating chamber, however, as can be seen from FIGS. 3*a* to 3*c*. When the proportional solenoid 32 is not energized, the actuating valve 28 is situated in its basic position shown, in which the pilot oil connection between the working connection A and the high-pressure connection P is opened, so that the high pressure acts in the actuating chamber 42—the swash plate 20 swivels in. When the proportional solenoid 32 is energized the actuating chamber 42 is connected to the low-pressure connection T, so that the pump accordingly swivels out.

In principle the designs described above can be used both in hydraulic motors and in hydraulic pumps, only minor adaptations being necessary. For example, the working point in the case of hydraulic motors according to the disclosure is selected so that a larger opening cross section is provided for swiveling the swash plate 20 of the hydraulic motor 1 out. This shifting of the working point makes it possible to use a solenoid having a shorter stroke and hence a greater force, without adversely affecting the swivel time. To compensate for this shifting of the working point the stiffness of the return spring 22 can be correspondingly increased. The control cut-off described is effective both in pumps and in motors. A further advantage of the solution according to the disclosure is that the connecting duct 76 for connecting the solenoid chamber 74 and the actuating chamber 42 and the two ducts 44, 45 are laid into the actuating valve housing 40.

Another difference when using the design according to the disclosure in a hydraulic pump compared to use in a hydraulic motor is that the measuring spring 61 in a hydraulic pump is designed with a somewhat reduced spring characteristic. If, for example, a spring force of, say, 40N is necessary in the case of a hydraulic motor, the measuring spring 61 would be set to approximately 30N for use as a hydraulic pump. A corresponding adjustment should then also be made to the proportional solenoid. In principle, therefore, the control piston 48 is more strongly tensioned in motor operation due to the somewhat stronger proportional solenoid 32 and the stronger measuring spring 61. This modification can basically also be used to advantage in a hydraulic pump.

In principle the actuating valve may be designed as a mounted valve for external attachment, or as a cartridge valve, in the manner previously described.

It is naturally possible, by means of an overriding control, also to regulate the torque or the pressure of the motor electronically by controlling the swivel angle of the swash plate, as described above, provided that these variables are registered and evaluated by the system.

A hydraulic motor of axial-piston design is disclosed, in which a swivel angle of swash plate is electro-proportionally adjustable.

LIST OF REFERENCE NUMERALS

1 hydraulic motor
2 housing
4 cover
6 shaft bearing
8 motor shaft
10 cylindrical drum
12 piston
13 cylinder bore
14 working chamber
16 control disk
18 slide shoe
20 swash plate
22 return spring
24 actuating device

26 actuating cylinder
28 actuating valve
30 stop
31 non-return valve
32 proportional solenoid
34 mount
36 actuating piston
38 ball-and-socket joint
40 actuating valve housing
42 actuation chamber
44 duct
45 duct
46 valve bore
48 control piston
50 control groove
52 control groove
54 control edge
56 control edge
58 control edge
60 taper
61 measuring spring
62 valve body
64 valve seat
66 internal bore
68 tappet
70 spring
72 spring abutment
74 solenoid chamber
76 connecting duct
78 control edge

What is claimed is:

1. A hydraulic axial piston machine, comprising:

a cylindrical drum defining a plurality of cylinder bores;

a plurality of pistons, each of which is guided in a respective cylinder bore of the plurality of cylinder bores, the plurality of pistons each defining a working chamber and being supported on a swash plate having an adjustable swivel angle;

an actuating device including (i) an actuating cylinder configured to adjust the swivel angle of the swash plate so as to adjust a displacement of the hydraulic axial piston machine and (ii) an actuating valve having a proportionally adjustable control piston, the actuating cylinder defining an actuation chamber configured to be connected to high or low pressure via the control piston, the control piston having a first control edge, a second control edge, a third control edge, and an fourth control edge; and a measuring spring configured for forcibly feeding back the swivel angle to the control piston, wherein, in a control cut-off position of the control piston:

a first pilot oil connection between the actuation chamber and the low pressure is opened by the first control edge;

a second pilot oil connection between the actuation chamber and the high pressure is closed by the second control edge; and a third pilot oil connection between the actuation chamber and the low pressure is closed by the third control edge, the third pilot oil connection being different from the first pilot oil connection.

2. The hydraulic axial piston machine according to claim 1, wherein:

the actuating valve is configured to be adjusted by a proportional solenoid;

a tappet submerges into a solenoid chamber into which a tappet-side end portion of the control piston also projects, the tappet-side end portion of the control piston being biased by the measuring spring into a position in which the tappet-side end portion bears against the tappet; and the solenoid chamber is permanently fluidly connected to the actuation chamber through a first portion of the first pilot oil connection, and the first control edge controls a second portion of the first pilot oil connection that connects the low pressure to the solenoid chamber so as to open and close the first pilot oil connection.

3. The hydraulic axial piston machine according to claim 2, wherein the actuating valve further comprises a control valve housing in which the control piston is arranged, and the control valve housing defines a connecting duct via which the solenoid chamber is permanently connected to the actuation chamber.

4. The hydraulic axial piston machine according to claim 1, further comprising a non-return valve configured to connect the actuating chamber to the high pressure, bypassing the second pilot oil connection, in order to prioritize inward swivel of the swash plate.

5. The hydraulic axial piston machine according to claim 4, wherein the non-return valve is arranged coaxially with the actuating valve.

6. The hydraulic axial piston machine according to claim 4, wherein:

the measuring spring has a first side supported on the actuating cylinder and a second side supported on a valve body of the non-return valve, which is pretensioned against the control piston and together with the control piston forms the non-return valve, and an internal bore, in which the high pressure acts when the non-return valve is open, is defined in the control piston.

7. The hydraulic axial piston machine according to claim 1, wherein the actuating cylinder has a cupped configuration, the measuring spring is accommodated in the actuating cylinder, and a valve body is guided in the actuating cylinder.

8. The hydraulic axial piston machine according to claim 7, wherein an axial length of the valve body and guidance of the valve body in the actuating cylinder are optimized for tilting stability.

9. The hydraulic axial piston machine according to claim 1, wherein:

the actuating valve further comprises a control valve housing in which the control piston is arranged;

the actuating valve has a low-pressure connection connected to the low pressure, a working connection, and a pressure connection connected to the high pressure; and the control valve housing defines two intersecting radial ducts assigned to the working connection, and the control valve housing defines at least one further duct, which forms a fourth pilot oil connection that connects the actuation chamber and the working connection.

10. The hydraulic axial piston machine according to claim 1, further comprising:

a proportional solenoid configured to adjust a position of the control piston, wherein, when the proportional solenoid is not energized, the control piston is moved into a control cut-off position.

11. The hydraulic axial piston machine according to claim 10, wherein, in a first energized state of the proportional solenoid, the first pilot oil connection is closed, the second pilot oil connection is open, and the third pilot oil connection is closed.

12. The hydraulic axial piston machine according to claim 11, wherein, in a second energized state of the proportional solenoid, the first pilot oil connection is closed, the second pilot oil connection is closed, and the third pilot oil connection is open.

* * * * *